US009267675B2

(12) United States Patent
Wu

(10) Patent No.: US 9,267,675 B2
(45) Date of Patent: Feb. 23, 2016

(54) LIGHT-EMITTING DIODE BULB WITH LOUDSPEAKER FUNCTION

(71) Applicant: WELL SHIN TECHNOLOGY CO., LTD., Taipei (TW)

(72) Inventor: Jui Hsiung Wu, Taipei (TW)

(73) Assignee: WELL SHIN TECHNOLOGY CO., LTD., Taipei (TW)

( * ) Notice: Subject to any disclaimer, the term of this patent is extended or adjusted under 35 U.S.C. 154(b) by 104 days.

(21) Appl. No.: 14/329,852

(22) Filed: Jul. 11, 2014

(65) Prior Publication Data

US 2016/0010846 A1 Jan. 14, 2016

(51) Int. Cl.

| | |
|---|---|
| ***H04R 1/02*** | (2006.01) |
| ***H04R 3/12*** | (2006.01) |
| ***F21V 33/00*** | (2006.01) |
| ***F21V 29/83*** | (2015.01) |
| ***F21V 23/06*** | (2006.01) |
| ***F21V 23/00*** | (2015.01) |
| *F21Y 101/02* | (2006.01) |

(52) U.S. Cl.

CPC ..... *F21V 33/0056* (2013.01); *F21V 23/009* (2013.01); *F21V 23/06* (2013.01); *F21V 29/83* (2015.01); *H04R 1/028* (2013.01); *F21Y 2101/02* (2013.01)

(58) Field of Classification Search

CPC .... H04R 1/028; H04R 1/02; H04R 2201/021; H04R 1/023; H04R 1/026; H04R 1/30; H04R 1/345; H04R 2209/041; H04R 2420/07; H04R 2499/11; H04R 2499/15; H04R 3/14; H04R 7/04; H04R 9/025; H04R 9/00

See application file for complete search history.

(56) References Cited

U.S. PATENT DOCUMENTS

| | | | | |
|---|---|---|---|---|
| 2004/0005072 | A1* | 1/2004 | Chuang | H04R 1/026 381/393 |
| 2008/0298045 | A1* | 12/2008 | Wright | F21V 33/0056 362/86 |
| 2009/0207607 | A1* | 8/2009 | Haase | F21K 9/13 362/234 |
| 2011/0133655 | A1* | 6/2011 | Recker | H02J 9/02 315/159 |
| 2011/0317861 | A1* | 12/2011 | Haase | F21V 33/0056 381/333 |
| 2013/0272535 | A1* | 10/2013 | Yuan | H04R 1/023 381/77 |
| 2014/0355246 | A1* | 12/2014 | Yotsumoto | F21K 9/1355 362/86 |
| 2015/0053790 | A1* | 2/2015 | Hanna | B05B 1/18 239/289 |
| 2015/0070895 | A1* | 3/2015 | Yotsumoto | F21K 9/1355 362/253 |
| 2015/0264458 | A1* | 9/2015 | Rutherford | H04R 1/028 381/394 |

* cited by examiner

*Primary Examiner* — Dionne H Pendleton
(74) *Attorney, Agent, or Firm* — Lin & Associates Intellectual Property, Inc.

(57) ABSTRACT

A light-emitting diode bulb with loudspeaker function includes a bulb head, a drive power assembly, a heat radiator, a light-emitting diode module, a loudspeaker assembly, and a cover covered on the heat radiator. The drive power assembly is assembled to an upper portion of the bulb head, and is electrically connected with the bulb head. The drive power assembly includes a power supply circuit board assembly and a wireless module. The heat radiator is mounted to the upper portion of the bulb head. The drive power assembly is received in the heat radiator. The light-emitting diode module is mounted on the heat radiator, and is electrically connected with the power supply circuit board assembly. The loudspeaker assembly mounted on the light-emitting diode module, the heat radiator and the drive power assembly includes a fastening holder, an audio circuit board, a fastening bracket and a speaker unit.

13 Claims, 12 Drawing Sheets

LIGHT-EMITTING DIODE BULB WITH LOUDSPEAKER FUNCTION

BACKGROUND OF THE INVENTION

1. Field of the Invention

The present invention relates to a light-emitting diode bulb, and more particularly to a light-emitting diode bulb with loudspeaker function.

2. The Related Art

As is known to all, a light fixture is one of household articles which are indispensable in people's daily lives. Nowadays, with the progress of science and technology, and the improvement of people's living standard, people's requirement for the light fixture is correspondingly improved, in order to satisfy the people's requirement for the light fixture, a variety of excellent light fixtures, such as light-emitting diode (LED) bulbs are emerged at the right moment. The light-emitting diode bulb has become the widely-used light fixture on account of the light-emitting diode bulb being far superior to the traditional light fixture in the light principle, energy saving, environmental protection etc.

A current light-emitting diode bulb includes a bulb head, a power supply circuit board assembly, a heat radiator, a light-emitting diode module and a cover. The power supply circuit board assembly is assembled to the bulb head. The heat radiator is of hollow shape with a middle of a bottom end thereof being opened. The heat radiator is mounted to the bulb head, and the power supply circuit board assembly is received in the heat radiator. The light-emitting diode module is mounted to the heat radiator. The cover is covered on the heat radiator to make the light-emitting diode module located between the cover and the heat radiator.

However, the current light-emitting diode bulb can only realize the illuminating function to make the light-emitting diode bulb just have the single function. Furthermore, in the place of assembling the light-emitting diode bulb, when people listen to music without an earphone, it usually needs to use an external sound box for playing the music outside, in the process of using the external sound box to play the music, it needs to proceed a complex connection of cables that affects a use convenience of the light-emitting diode bulb.

SUMMARY OF THE INVENTION

An object of the present invention is to provide a light-emitting diode bulb with loudspeaker function. The light-emitting diode bulb with loudspeaker function includes a bulb head, a drive power assembly, a heat radiator, a light-emitting diode module, a loudspeaker assembly and a cover. The drive power assembly is assembled to an upper portion of the bulb head, and is electrically connected with the bulb head. The drive power assembly includes a power supply circuit board assembly, and a wireless module disposed to a top end of the power supply circuit board assembly. The heat radiator is mounted to the upper portion of the bulb head. The drive power assembly is received in the heat radiator. The light-emitting diode module is mounted on the heat radiator, and is electrically connected with the power supply circuit board assembly of the drive power assembly. The loudspeaker assembly is mounted on the light-emitting diode module, the heat radiator and the drive power assembly. The loudspeaker assembly includes a fastening holder mounted on the light-emitting diode module, the heat radiator and the drive power assembly, an audio circuit board disposed to the fastening holder and electrically connected with the power supply circuit board assembly, a fastening bracket mounted on the audio circuit board, the fastening holder, the light-emitting diode module and the heat radiator, and a speaker unit fastened to the fastening bracket and electrically connected with the audio circuit board which has a main board, a Bluetooth integrated circuit chip disposed on the main board, and a power amplifier chip disposed on the main board. The cover is covered on the heat radiator to locate the light-emitting diode module and the loudspeaker assembly between the cover and the heat radiator. A top of the cover defines a plurality of through-holes.

As described above, the light-emitting diode bulb with loudspeaker function is capable of realizing the illuminating function and the music playing function to make the light-emitting diode bulb with loudspeaker function have the dual functions. Furthermore, in the place of installing the light-emitting diode bulb with loudspeaker function, when the people listen to the music without the earphone, it just need make the smartphone, the panel personal computer or other device and the Bluetooth integrated circuit chip of the audio circuit board proceed the Bluetooth search matching, the power supply circuit board assembly of the drive power assembly provides the power for the loudspeaker assembly, the audio circuit board drives the speaker unit to make the sound so that the light-emitting diode bulb with loudspeaker function plays the music outside, in the process of using the light-emitting diode bulb with loudspeaker function to play the music, it has no need for proceeding the complex connection of the cables. As a result, it is beneficial for a use convenience of the light-emitting diode bulb with loudspeaker function.

BRIEF DESCRIPTION OF THE DRAWINGS

The present invention will be apparent to those skilled in the art by reading the following description thereof, with reference to the attached drawings, in which.

DETAILED DESCRIPTION OF THE EMBODIMENT

Figure 1:
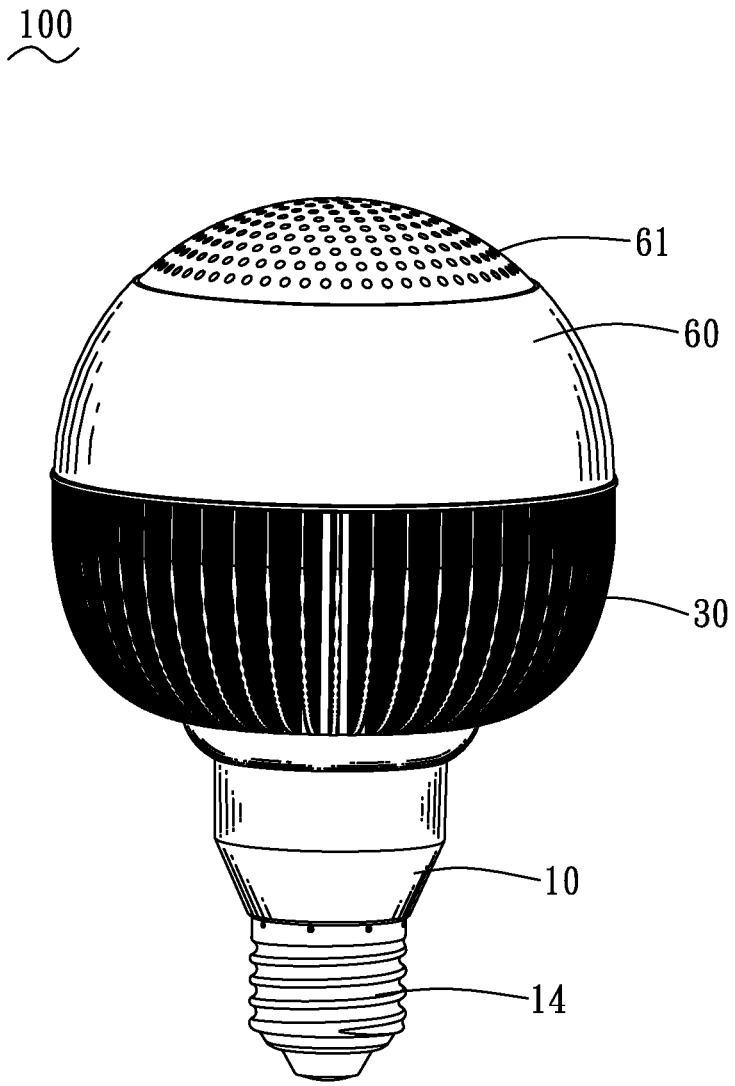
FIG. 1 is a perspective view of a light-emitting diode bulb with loudspeaker function according to an embodiment of the present invention.
Figure 2:
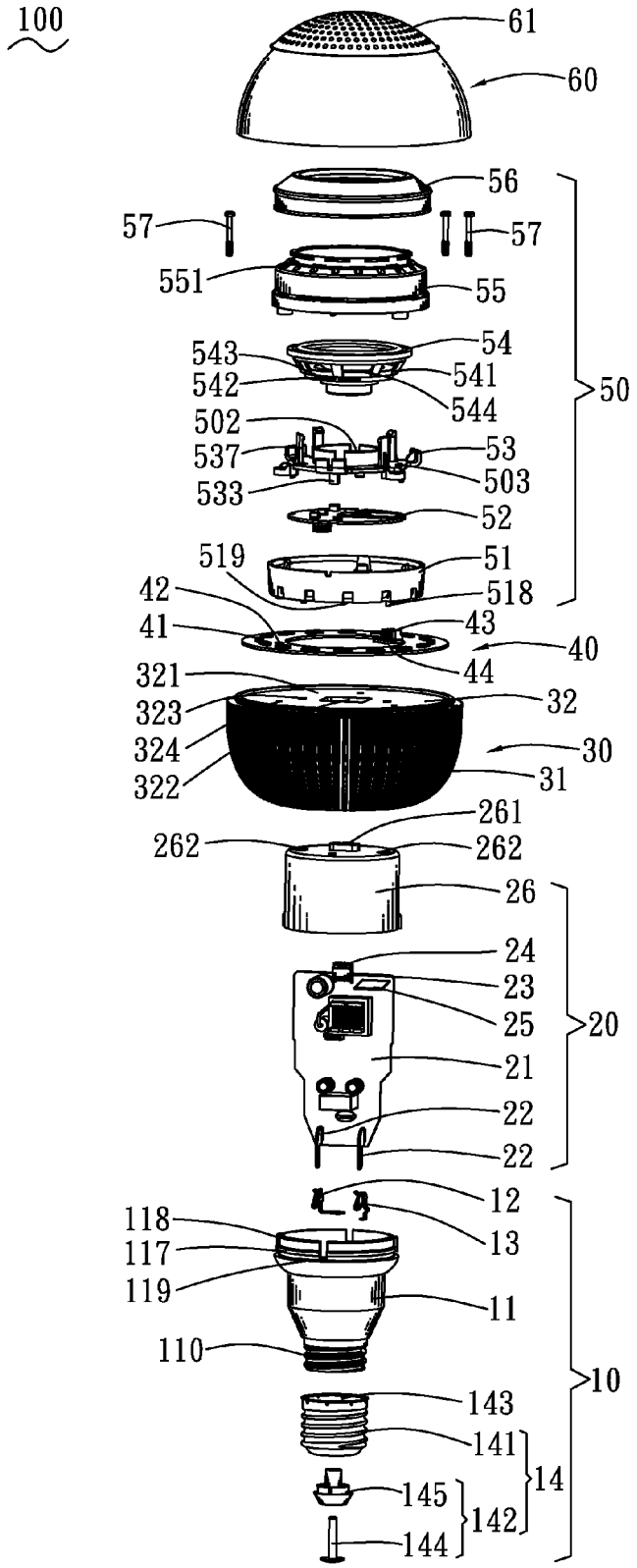
FIG. 2 is an exploded view of the light-emitting diode bulb with loudspeaker function of FIG. 1.

Referring to FIG. 1 and FIG. 2, a light-emitting diode bulb with loudspeaker function 100 according to an embodiment of the present invention is shown. The light-emitting diode bulb with loudspeaker function 100 includes a bulb head 10, a drive power assembly 20, a heat radiator 30, a light-emitting diode module 40, a loudspeaker assembly 50 and a cover 60.

Figure 3:
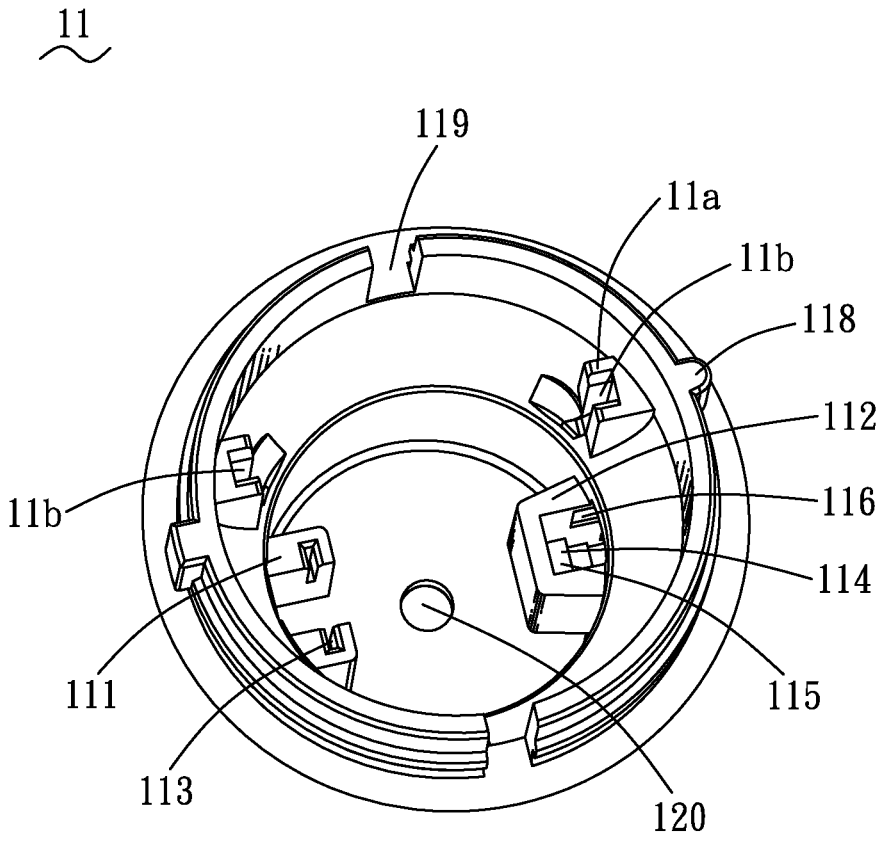
FIG. 3 is a perspective view of an inner housing of the light-emitting diode bulb with loudspeaker function of FIG. 2.

Referring to FIG. 1, FIG. 2 and FIG. 3, the bulb head 10 includes an inner housing 11, a plurality of electrical terminals and a power connection unit 14. The inner housing 11 is of hollow cone shape with a middle of a top end thereof being freely opened. Two opposite sides of an inside wall of the inner housing 11 protrude inward to form a pair of positioning blocks 11*a* at an upper position thereof, and two spaced fastening blocks 111 and a U-shaped receiving frame 112 at a lower position thereof. A pair of positioning slots 11*b* is opened in two face-to-face sides of the positioning blocks 11*a* and further penetrates upward through the positioning blocks 11*a* respectively. A pair of fastening slots 113 is opened in two face-to-face sides of the fastening blocks 111 and further penetrates upward through the fastening blocks 111.

Referring to FIG. 1, FIG. 2 and FIG. 3 again, the receiving frame 112 defines a receiving chamber 114 further penetrating outward through the inner housing 11 to communicate with outside. A bottom of an inner side of the receiving frame 112 protrudes into the receiving chamber 114 to form a supporting board 115. Two opposite inner sidewalls of the receiving chamber 114 are oppositely concaved to form a pair of fixing fillisters 116. A middle of a bottom wall of the inner housing 11 defines a perforation 120. The inner housing 11 defines a male thread 110 around an outside of a bottom end thereof. A ring-shaped locking rib 117 is protruded outward around an outside of a top end of the inner housing 11. The top end of the inner housing 11 defines a pair of first gaps 119. The top end of the inner housing 11 is divided into two sections by the pair of first gaps 119. A middle of an outer surface of each section of the top end of the inner housing 11 protrudes outward to form a locating portion 118.

Figure 4:
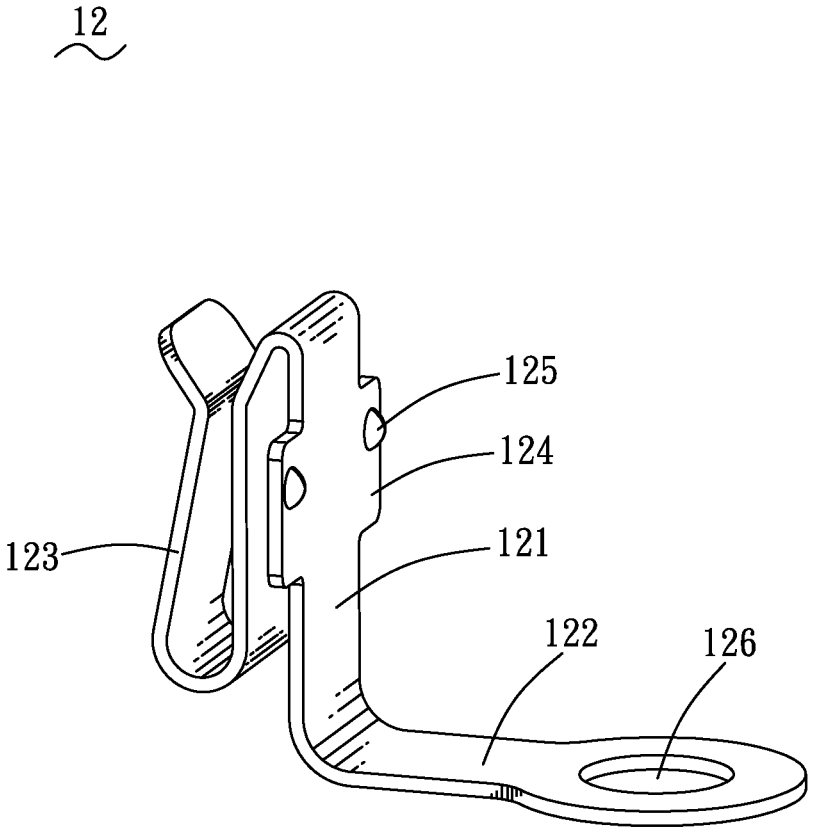
FIG. 4 is a perspective view of an anode terminal of the light-emitting diode bulb with loudspeaker function of FIG. 2.

Referring to FIG. 2, FIG. 3 and FIG. 4, the electrical terminals are apart disposed in the inner housing 11, and include an anode terminal 12 and a cathode terminal 13. The anode terminal 12 has a first base portion 121 of vertical long board shape, a first connecting portion 122 of long board shape perpendicularly extending sideward from a bottom end of the base portion 121, and a U-shaped first contact portion 123 bent and extending oppositely to the first connecting portion 122 from a top end of the base portion 121. Two upper portions of two arms of the first contact portion 123 are arched towards each other to make the first contact portion 123 be able to afford greater insertion and withdrawal forces.

Referring to FIG. 2, FIG. 3 and FIG. 4 again, a free end of the first connecting portion 122 defines an inserting hole 126. Two side edges of the first base portion 121 oppositely protrude sideward to form two fastening ears 124 on which two interfering lumps 125 are protruded respectively. The fastening ears 124 are fixed in the fastening slots 113 of the inner housing 11 by virtue of the interfering lumps 125 interfering with inner sides of the fastening slots 113, so as to make the first base portion 121 and the first contact portion 123 steadily located between the fastening blocks 111. The first connecting portion 122 abuts on the bottom wall of the inner housing 11 to make the inserting hole 126 corresponding to the perforation 120.

Figure 5:
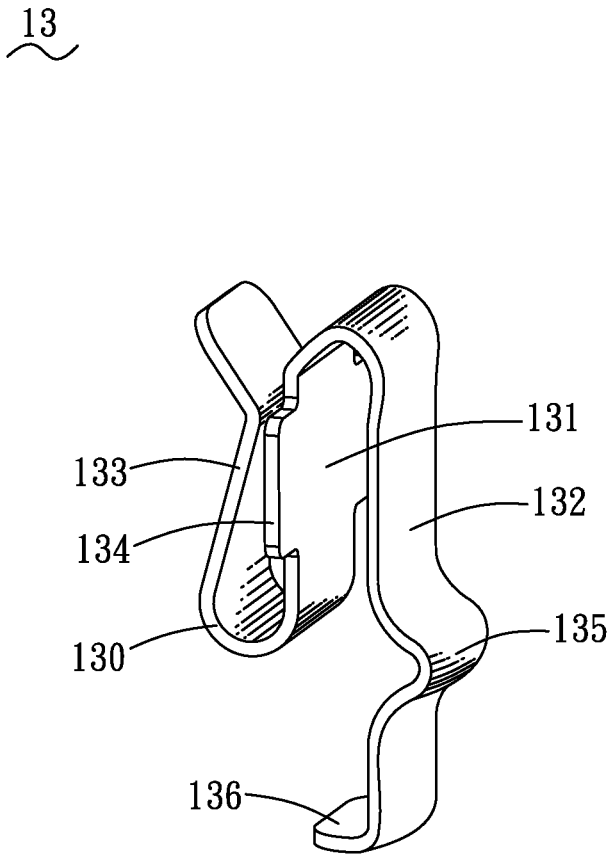
FIG. 5 is a perspective view of a cathode terminal of the light-emitting diode bulb with loudspeaker function of FIG. 2.

Referring to FIG. 2, FIG. 3 and FIG. 5, the cathode terminal 13 has a U-shaped second contact portion 130 and a second connecting portion 132 which is bent oppositely to the second contact portion 130 from a top end of the second contact portion 130 and then extends downward. Specifically, the second contact portion 130 has a board-shaped second base portion 131 disposed vertically, and a first resisting portion 133 bent opposite to the second connecting portion 132 and then extending upward from a bottom end of the second base portion 131. An upper portion of the first resisting portion 133 is arched towards the second base portion 131 to make the second contact portion 130 be able to afford greater insertion and withdrawal forces. Two side edges of the second base portion 131 oppositely protrude sideward to form a pair of fixing ears 134. A lower portion of the second connecting portion 132 is arched outward to form a second resisting portion 135. A bottom end of the second connecting portion 132 is bent towards a direction opposite to the second resisting portion 135 to form a restraining portion 136.

Referring to FIG. 2, FIG. 3 and FIG. 5 again, the cathode terminal 13 is disposed in the receiving chamber 114 of the inner housing 11 by virtue of the fixing ears 134 being fixed in the fixing fillisters 116. The bent portion of the second contact portion 130 is propped by the supporting board 115. The second resisting portion 135 projects out of the inner housing 11 and corresponds to the male thread 110. The restraining portion 136 is restrained under the bottom wall of the inner housing 11.

Referring to FIG. 1, FIG. 2, FIG. 3, FIG. 4, FIG. 5 and FIG. 12, the power connection unit 14 is mounted to the bottom end of the inner housing 11 and electrically connects with the electrical terminals. The power connection unit 14 includes a cylinder bulb base 141 and an anode element 142 which is mounted to a bottom end of the bulb base 141 and projects upward in the bulb base 141. Specifically, the bulb base 141 defines a female thread 143 around an inside thereof. The power connection unit 14 and the inner housing 11 are screwed together by the female thread 143 and the male thread 110, so that the second resisting portion 135 of the cathode terminal 13 is pressed by and abuts against the bulb base 141 to realize an electrical connection between the cathode terminal 13 and the bulb base 141.

Referring to FIG. 1, FIG. 2, FIG. 3, FIG. 4, FIG. 5 and FIG. 12 again, a top end of the anode element 142 passes through the perforation 120 of the inner housing 11 and the inserting hole 126 of the anode terminal 12 to be riveted with the first connecting portion 122 so as to realize an electrical connection between the anode terminal 12 and the anode element 142. In this embodiment, the anode element 142 includes a rivet 144 and a rivet boot 145 in which the rivet 144 is inserted, in detail, a top end of the rivet 144 passes through the perforation 120 and the inserting hole 126 to be riveted with the first connecting portion 122 so as to realize the electrical connection between the anode terminal 12 and the anode element 142.

Referring to FIG. 2, FIG. 3, FIG. 4 and FIG. 5, the drive power assembly 20 is assembled to an upper portion of the bulb head 10, and is electrically connected with the bulb head 10. The drive power assembly 20 includes a power supply circuit board assembly 21, two sheet power pins 22, a first connector 23, a second connector 24 docked with the first connector 23, a wireless module 25 based on Bluetooth technology or Wi-Fi technology, and a cylinder shell 26.

Referring to FIG. 2, FIG. 3, FIG. 4 and FIG. 5 again, the power supply circuit board assembly 21 is vertically assembled to the inner housing 11 by virtue of two sides of a bottom end thereof being respectively inserted in the positioning slots 11*b* for making the power supply circuit board assembly 21 firmly assembled to the inner housing 11. The power pins 22 are respectively assembled to two opposite sides of the bottom end of the power supply circuit board assembly 21 and project downward beyond the bottom end of the power supply circuit board assembly 21. The power pins 22 are inserted and clamped in the first contact portion 123 of the anode terminal 12 and the second contact portion 130 of the cathode terminal 13 to realize electrical connection with the anode terminal 12 and the cathode terminal 13, respectively.

Referring to FIG. 2, the first connector 23 is mounted to a top end of the power supply circuit board assembly 21, and is electrically connected with the power pins 22. The second connector 24 is docked with the first connector 23. The wireless module 25 is disposed to the top end of the power supply circuit board assembly 21, and is spaced from the first connector 23 and the second connector 24. The shell 26 is of hollow shape with a middle of a bottom end thereof being freely opened, and the shell 26 surrounds the power supply circuit board assembly 21. A middle of a top surface of the shell 26 opens a first opening 261 corresponding to a position where the first connector 23 is located. Two opposite sides of the top surface of the shell 26 are concaved downward to form two locking fillisters 262. The second connector 24 and a top end of the first connector 23 pass through the first opening 261 to project beyond the top surface of the shell 26.

Figure 12:
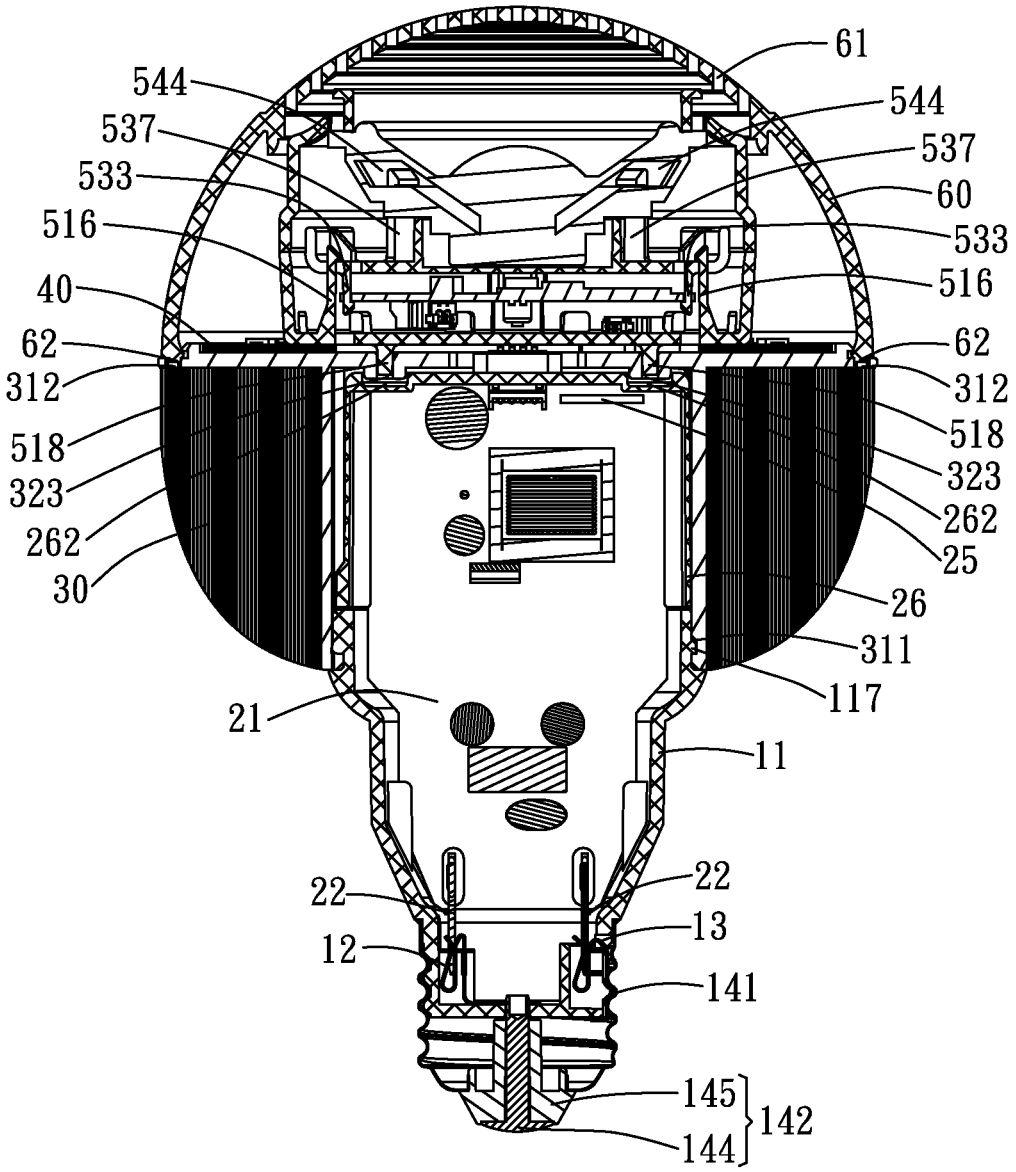
FIG. 12 is a sectional view of the light-emitting diode bulb with loudspeaker function of FIG. 1.

Referring to FIG. 2 and FIG. 12, the heat radiator 30 is mounted to the upper portion of the bulb head 10. The heat radiator 30 is of hollow shape with a middle of a bottom end thereof being freely opened. The drive power assembly 20 is received in the heat radiator 30. The heat radiator 30 includes a main body 31, and a sealing board 32 disposed on a top end of the main body 31. The main body 31 is surrounded to hollow semispherical shape by a plurality of radiator fins. An inner sidewall of a bottom end of the main body 31 defines a ring-shaped locking channel 311 and at least one positioning groove (not shown). The main body 31 is mounted to the inner housing 11 by buckling the locking rib 117 in the locking channel 311, so the main body 31 is firmly mounted to the inner housing 11 even if a high temperature happens in use.

Referring to FIG. 2 and FIG. 12 again, two opposite sides of the top end of the main body 31 define two inserting grooves 312. A middle of a top of the sealing board 32 is concaved downward to form a receiving groove 321. A middle of a bottom sidewall of the receiving groove 321 of the heat radiator 30 opens a second opening 322 corresponding to the first opening 261 of the shell 26. The bottom sidewall of the receiving groove 321 of the heat radiator 30 defines two locking holes 323 respectively corresponding to the locking fillisters 262 of the shell 26, and a plurality of retaining holes 324. The heat radiator 30 is mounted to the inner housing 11 by virtue of the main body 31. The power supply circuit board assembly 21, the wireless module 25 and the shell 26 of the drive power assembly 20 are received in the main body 31 of the heat radiator 30. A top end of the second connector 24 passes through the second opening 322 of the heat radiator 30 to project beyond the bottom sidewall of the receiving groove 321. In assembly, the inner housing 11 utilizes the first gap 119 to achieve an easy assembly with the main body 31.

Referring to FIG. 2, the light-emitting diode module 40 is mounted on the heat radiator 30, and is electrically connected with the power supply circuit board assembly 21 of the drive power assembly 20. The light-emitting diode module 40 is mounted to the sealing board 32, and is received in the receiving groove 321 of the heat radiator 30. The light-emitting diode module 40 is of ring shape. The light-emitting diode module 40 includes a plurality of first light-emitting diode chips 41 distributed around a top thereof, a third connector 43 disposed to the top of the light-emitting diode module 40 and spaced from the first light-emitting diode chips 41, and a fourth connector 44 docked with the third connector 43. The light-emitting diode module 40 defines a plurality of fixing holes 42 corresponding to the retaining holes 324. The top end of the second connector 24 of the power supply circuit board assembly 21 passes through a middle of the light-emitting diode module 40 by a first cable (not shown) to electrically connect with the fourth connector 44 docked with the third connector 43 disposed to the top of the light-emitting diode module 40 for making the light-emitting diode module 40 electrically connect with the power supply circuit board assembly 21 of the drive power assembly 20.

Referring to FIG. 2, the loudspeaker assembly 50 is mounted on the light-emitting diode module 40, the heat radiator 30 and the drive power assembly 20. The loudspeaker assembly 50 includes a fastening holder 51, an audio circuit board 52 electrically connect with the power supply circuit board assembly 21, a fastening bracket 53, a speaker unit 54 electrically connected with the audio circuit board 52, a loudspeaker retainer ring 55, a sealing ring 56 and a plurality of fastening elements 57. In this embodiment, the fastening elements 57 are screws.

Figure 6:
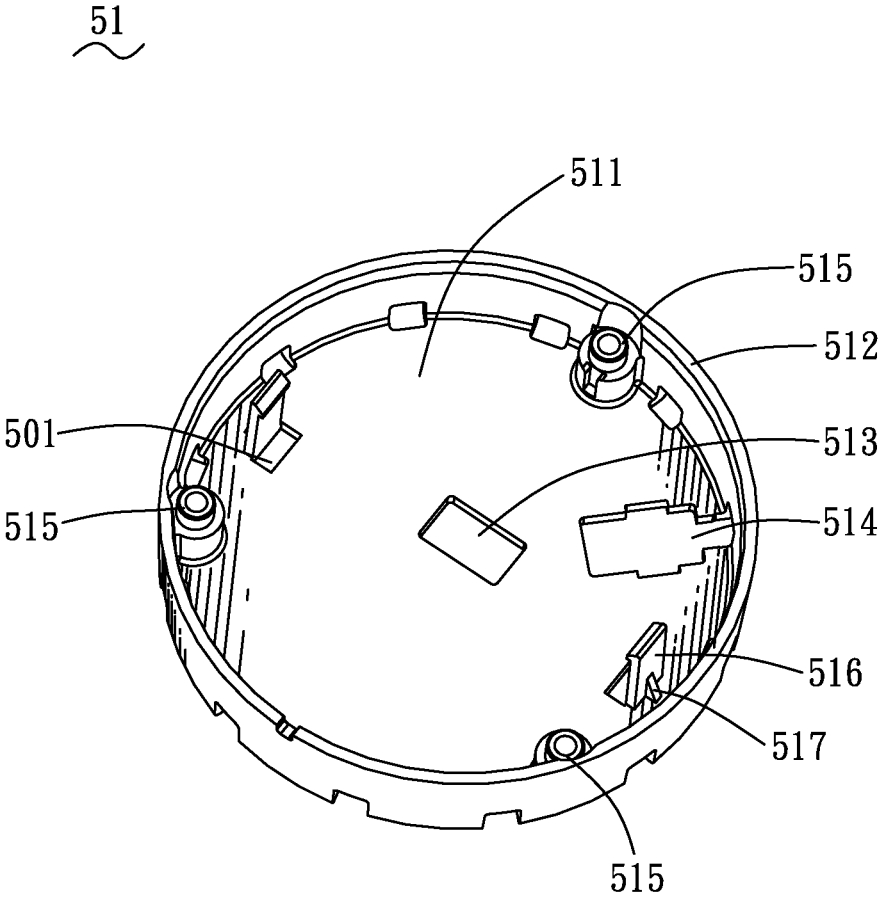
FIG. 6 is a perspective view of a fastening holder of a loudspeaker assembly of the light-emitting diode bulb with loudspeaker function of FIG. 2.
Figure 7:
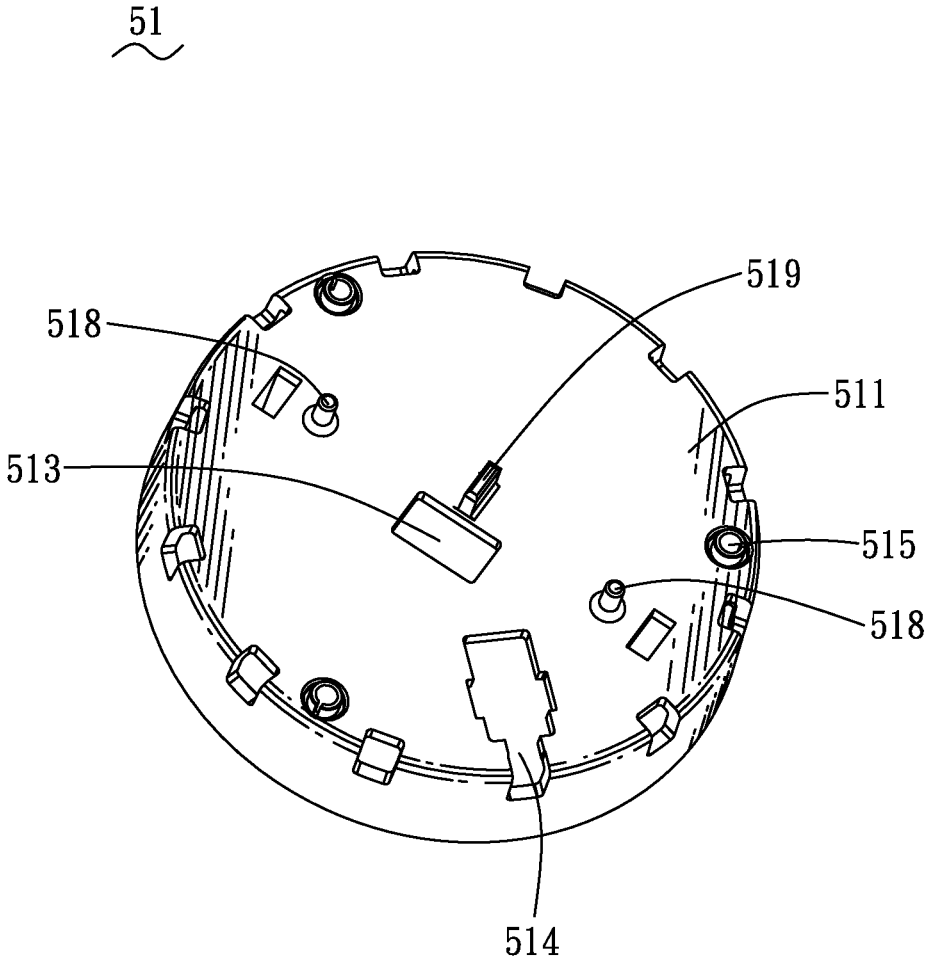
FIG. 7 is another perspective view of the fastening holder of the loudspeaker assembly of the light-emitting diode bulb with loudspeaker function of FIG. 2.
Figure 8:
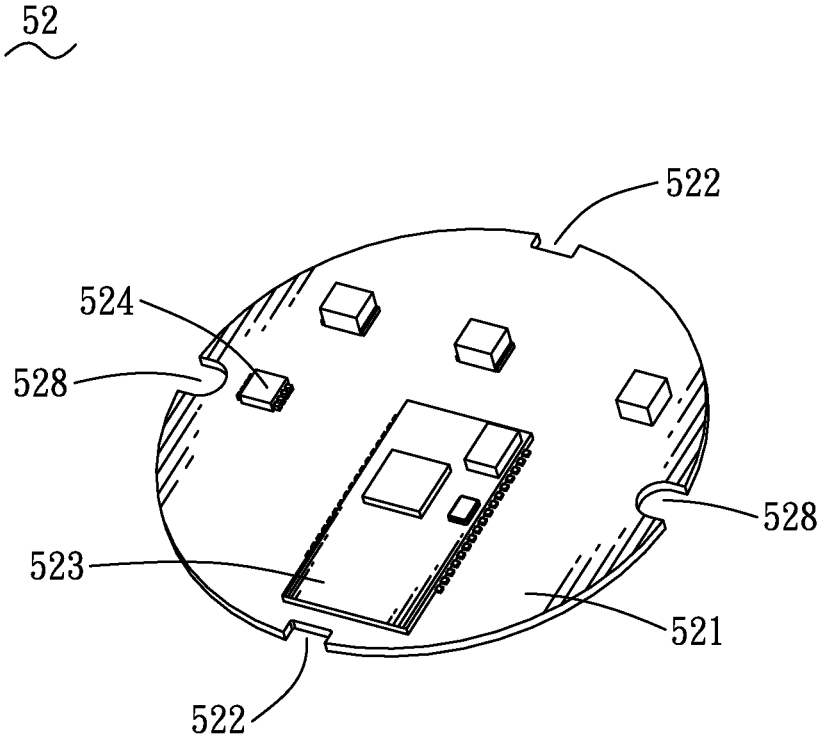
FIG. 8 is a perspective view of an audio circuit board of the loudspeaker assembly of the light-emitting diode bulb with loudspeaker function of FIG. 2.
Figure 9:
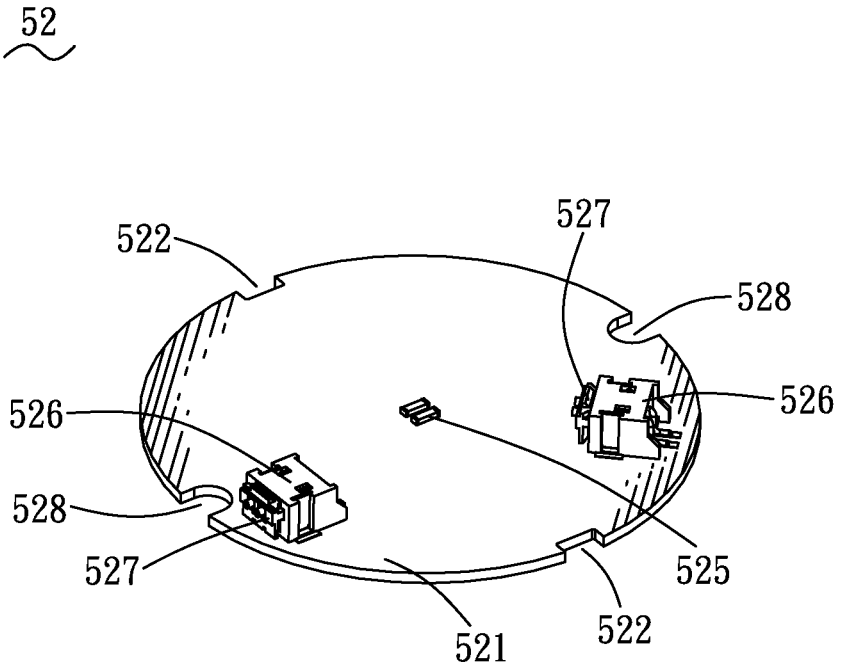
FIG. 9 is another perspective view of the audio circuit board of the loudspeaker assembly of the light-emitting diode bulb with loudspeaker function of FIG. 2.

Referring to FIG. 2, FIG. 6 and FIG. 7, the fastening holder 51 is mounted on the light-emitting diode module 40, the heat radiator 30 and the drive power assembly 20. The fastening holder 51 is of hollow cylinder shape with a middle of a top end thereof being freely opened. The fastening holder 51 has a bottom board 511, and a ring-shaped blocking board 512 protruding upward from a periphery of the bottom board 511. A middle of the bottom board 511 defines a third opening 513. A second cable is capable of passing through the middle of the light-emitting diode module 40 and the third opening 513. The fastening holder 51 defines a matching groove 514 penetrating through one side of the bottom board 511 and a bottom of the blocking board 512. The third connector 43 and the fourth connector 44 pass through the matching groove 514 to be exposed to a top surface of the bottom board 511. A periphery of the bottom board 511 of the fastening holder 51 defines a plurality of first fastening pillars 515 of which middles vertically penetrate therethrough. The first fastening pillars 515 are connected with an inner surface of the blocking board 512, and bottoms of the first fastening pillars 515 project under a bottom surface of the bottom board 511. Two opposite sides of the bottom board 511 define two first auxiliary holes 501. The two opposite sides of the bottom board 511 of the fastening holder 51 protrude upward to form two first buckling portions 516 with two top ends thereof showing hook shape. The two first buckling portions 516 are respectively located at outer sides of the two first auxiliary holes 501.

Referring to FIG. 2, FIG. 6, FIG. 7 and FIG. 12 again, two portions of the bottom board 511 of the fastening holder 51 protrude upward to form two first strengthening portions 517 connecting with outer surfaces of the two first buckling portions 516. Two opposite sides of the bottom surface of the bottom board 511 of the fastening holder 51 protrude downward to form two locking portions 518. The two locking portions 518 pass through the middle of the light-emitting diode module 40 and the two locking holes 323 of the heat radiator 30 to be locked in the locking fillisters 262 of the shell 26. A middle of the bottom surface of the bottom board 511 of the fastening holder 51 protrudes downward to form a propping portion 519. The propping portion 519 passes through the middle of the light-emitting diode module 40 to resist against the sealing board 32 for forming an interval between the bottom board 511 of the fastening holder 51 and the sealing board 32, so that the light-emitting diode module 40 is disposed between the bottom board 511 of the fastening holder 51 and the sealing board 32.

Referring to FIG. 2, FIG. 6, FIG. 8 and FIG. 9, the audio circuit board 52 is disposed to the fastening holder 51 and is electrically connected with the power supply circuit board assembly 21. Specifically, the audio circuit board 52 is disposed on the bottom board 511 of the fastening holder 51. The audio circuit board 52 has a main board 521, a Bluetooth integrated circuit chip 523 disposed on a top surface of the main board 521, a power amplifier chip 524 disposed on the top surface of the main board 521 and located at one side of the Bluetooth integrated circuit chip 523, two second light-emitting diode chips 525 disposed to a middle of a bottom surface of the main board 521, two fifth connectors 526 assembled to two opposite sides of the bottom surface of the main board 521, and two sixth connectors 527 docked with the two fifth connectors 526. Two opposite sides of the main board 521 of the audio circuit board 52 are recessed inward to form two recesses 522. A front and a rear of the main board 521 of the audio circuit board 52 are recessed inward to form two embedding grooves 528. The top end of the second connector 24 of the power supply circuit board assembly 21 passes through the middle of the light-emitting diode module 40 to electrically connect with the sixth connector 527 docked with one fifth connector 526 which is disposed to one side of the bottom surface of the main board 521 of the audio circuit board 52 by the second cable for making audio circuit board 52 electrically connect with the power supply circuit board assembly 21.

Referring to FIG. 2, FIG. 6, FIG. 8 and FIG. 10, the fastening bracket 53 is mounted on the audio circuit board 52, the fastening holder 51, the light-emitting diode module 40 and the heat radiator 30. The fastening bracket 53 has a base board 531. A middle of a top surface of the base board 531 of the fastening bracket 53 protrudes upward to form a supporting ring 532. A front and a rear of the supporting ring 532 respectively define a second gap 502 for saving molding materials of the supporting ring 532 and effectively preventing the supporting ring 532 from deforming. The base board 531 of the fastening bracket 53 defines two second auxiliary holes 503. Two opposite sides of a bottom surface of the base board 531 of the fastening bracket 53 protrude downward to form two second buckling portions 533 with two bottom ends thereof showing hook shape. The second buckling portions 533 are respectively located at outer sides of the second auxiliary holes 503. A front and a rear of the bottom surface of the base board 531 of the fastening bracket 53 protrude downward to form two embedding portions 530.

Referring to FIG. 2, FIG. 6, FIG. 8, FIG. 10 and FIG. 12, an outer periphery of the base board 531 of the fastening bracket 53 protrudes outward to form a plurality of spaced fastening boards 535 of which each defines a fastening hole 536. The base board 531 of the fastening bracket 53 defines a plurality of spaced third auxiliary holes 504 spaced from an outer surface of the supporting ring 532, and the third auxiliary holes 504 are located in front of and behind the third auxiliary holes 504. Several portions of a periphery of the top surface of the base board 531 of the fastening bracket 53 protrude upward to form a plurality of third buckling portions 537 with top ends thereof showing hook shape. The third buckling portion 537 is located at an outer side of the third auxiliary hole 504. Several portions of the periphery of the top surface of the base board 531 of the fastening bracket 53 protrude upward to form a plurality of second strengthening portions 534. The second strengthening portion 534 is connected with an outer side of the third buckling portion 537.

Referring to FIG. 2, FIG. 6, FIG. 8, FIG. 10 and FIG. 12 again, several portions of the outer periphery of the base board 531 extend outward and then are bent upward to form a plurality of supporting arms 538. An inner side and a bottom of the supporting arm 538 are connected with a third strengthening portion 539. A middle of the supporting arm 538 located at a front of the base board 531 defines a guiding slot 505 penetrating upward through a top thereof for guiding a correct assembling direction and aligning a proper assembling position. The fastening board 535 is disposed above the first fastening pillar 515, and the fastening hole 536 is corresponding to a middle of the first fastening pillar 515. The top end of the first buckling portion 516 hooks the top surface of the base board 531 of the fastening bracket 53 for fastening the fastening bracket 53 to the fastening holder 51 firmly. The bottom end of the second buckling portion 533 is buckled in the recess 522 of the audio circuit board 52 and hooks the bottom surface of the main board 521 of the audio circuit board 52 for fastening the audio circuit board 52 under the fastening bracket 53 firmly. The embedding portions 530 are embedded in the embedding grooves 528 of the audio circuit board 52.

Referring to FIG. 2, FIG. 9, FIG. 10, FIG. 11 and FIG. 12, the speaker unit 54 is fastened to the fastening bracket 53 and is electrically connected with the audio circuit board 52. A bottom of the speaker unit 54 is fastened to the supporting ring 532. An outer side of the speaker unit 54 defines a basin stand 541. The speaker unit 54 has two connecting pieces 542 connecting with a front of the basin stand 541. Each of the connecting pieces 542 defines a connecting hole 543 for connecting with a third cable. The third cable is electrically connected with the sixth connector 527 docked with the other fifth connector 526 which is disposed on the other side of the bottom surface of audio circuit board 52 for making the speaker unit 54 electrically connect with audio circuit board 52. The basin stand 541 defines a plurality of buckling grooves 544 penetrating therethrough. The top end of the third buckling portion 537 is buckled in the buckling groove 544 and hooks a bottom sidewall of the buckling groove 544 for making the speaker unit 54 firmly fastened above the fastening bracket 53.

Figure 10:
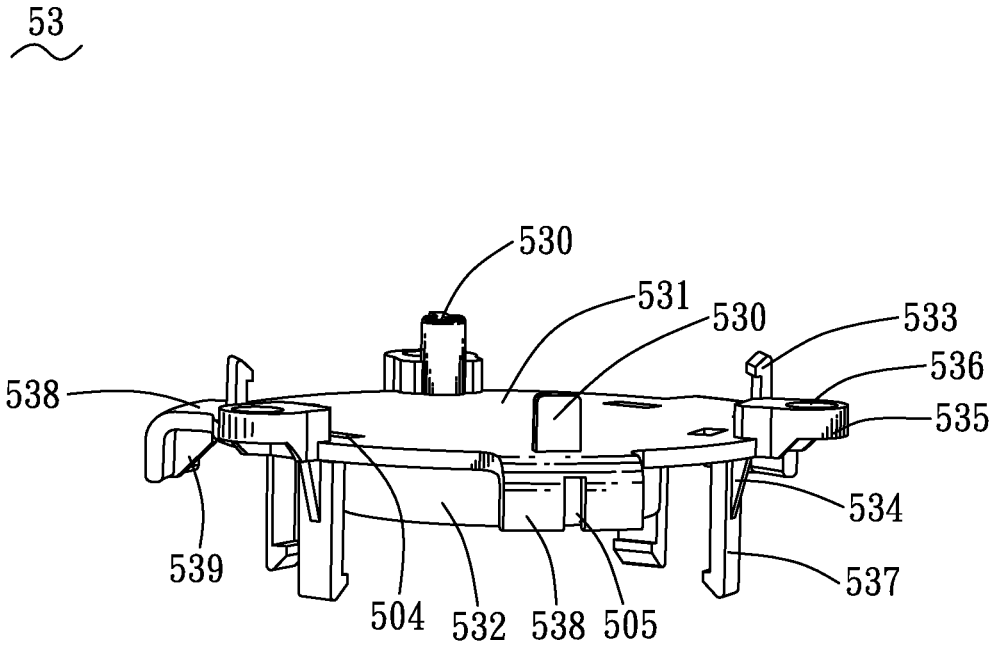
FIG. 10 is a perspective view of a fastening bracket of the loudspeaker assembly of the light-emitting diode bulb with loudspeaker function of FIG. 2.
Figure 11:
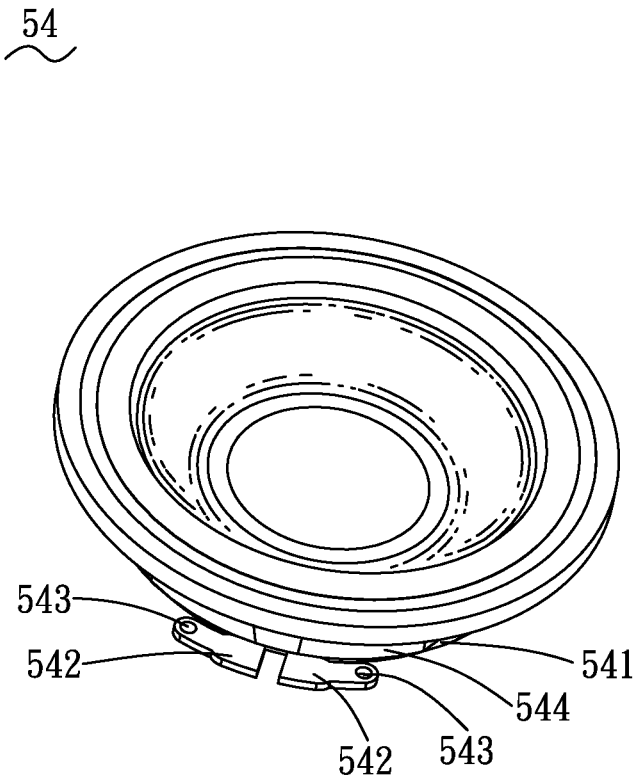
FIG. 11 is a perspective view of a speaker unit of the loudspeaker assembly of the light-emitting diode bulb with loudspeaker function of FIG. 2.

Referring to FIG. 2 and FIG. 10, the loudspeaker retainer ring 55 is mounted on the fastening bracket 53 and the fastening holder 51, and surrounds the speaker unit 54. The loudspeaker retainer ring 55 is of circular ring shape. A periphery of a top end of the loudspeaker retainer ring 55 defines a plurality of second fastening pillars 551 of which middles vertically penetrate therethrough. The second fastening pillars 551 are connected with an inner surface of the loudspeaker retainer ring 55, and bottoms of the second fastening pillars 551 project beyond a bottom surface of the loudspeaker retainer ring 55. A middle of the second fastening pillar 551 is corresponding to the fastening hole 536 of the fastening board 535, the middle of the first fastening pillar 515, the fixing hole 42 of the light-emitting diode module 40 and the retaining hole 324 of the heat radiator 30. The light-emitting diode module 40, the fastening holder 51, the audio circuit board 52, the fastening bracket 53, the speaker unit 54 and the loudspeaker retainer ring 55 of the loudspeaker assembly 50 are fastened to the heat radiator 30 by virtue of the fastening elements 57 passing through the middles of the second fastening pillars 551, the fastening holes 536 of the fastening boards 535, the middles of the first fastening pillars 515, the fixing holes 42 of the light-emitting diode module 40 and the retaining holes 324 of the heat radiator 30. The sealing ring 56 is sleeved around the periphery of the top end of the loudspeaker retainer ring 55.

Referring to FIG. 1, FIG. 2 and FIG. 12, the cover 60 is covered on the heat radiator 30. The cover 60 is of hollow semispherical shape with a middle of a bottom end thereof being freely opened. A top of the cover 60 defines a plurality of through-holes 61. Two opposite sides of the bottom end of the cover 60 protrude downward to form two inserting portions 62. The two inserting portions 62 are inserted into the two inserting grooves 312 for making the cover 60 firmly covered on the heat radiator 30 to locate the light-emitting diode module 40 and the loudspeaker assembly 50 between the cover 60 and the heat radiator 30.

Referring to FIG. 1 to FIG. 12, in use, the light-emitting diode bulb with loudspeaker function 100 can be installed to any place with a bulb interface, the wireless module 25 of the power supply circuit board assembly 21 of the drive power assembly 20 can connect with a smartphone, a panel personal computer or other device which supports the Bluetooth technology or the Wi-Fi technology, so that the smartphone, the panel personal computer or other device is capable of controlling the power supply circuit board assembly 21 of the drive power assembly 20 to drive the light-emitting diode module 40 to realize the illumination function. In addition, in the place of installing the light-emitting diode bulb with loudspeaker function 100, when people listen to music without an earphone, it just need make the smartphone, the panel personal computer or other device and the bluetooth integrated circuit chip 523 of the audio circuit board 52 proceed a Bluetooth search matching. In the process of the Bluetooth search matching, the second light-emitting diode chips 525 of the audio circuit board 52 flashes quickly, when the smartphone, the panel personal computer or other device and the Bluetooth integrated circuit chip 523 of the audio circuit board 52 complete the Bluetooth search matching to build a Bluetooth connection therebetween, the second light-emitting diode chips 525 is normally on, the power supply circuit board assembly 21 of the drive power assembly 20 provides power for the loudspeaker assembly 50, the audio circuit board 52 drives the speaker unit 54 to make a sound so that the light-emitting diode bulb with loudspeaker function 100 plays the music outside, at the moment, the second light-emitting diode chips 525 go out. Thus, the light-emitting diode bulb with loudspeaker function 100 is capable of realizing the music playing function.

Referring to FIG. 1 to FIG. 12 again, when the light-emitting diode bulb with loudspeaker function 100 is stopped playing the music outside, the second light-emitting diode chips 525 are normally on. When the Bluetooth connection between the smartphone, the panel personal computer or other device and the Bluetooth integrated circuit chip 523 of the audio circuit board 52 is disconnected, the smartphone, the panel personal computer or other device and the Bluetooth integrated circuit chip 523 of the audio circuit board 52 proceed the Bluetooth search matching again, in the process of the Bluetooth search matching, the second light-emitting diode chips 525 of the audio circuit board 52 flashes quickly. And in the process of using the light-emitting diode bulb with loudspeaker function 100 to play the music, it has no need for proceeding a complex connection of cables.

As described above, the light-emitting diode bulb with loudspeaker function 100 is capable of realizing the illuminating function and the music playing function to make the light-emitting diode bulb with loudspeaker function 100 have the dual functions. Furthermore, in the place of installing the light-emitting diode bulb with loudspeaker function 100, when the people listen to the music without the earphone, it just need make the smartphone, the panel personal computer or other device and the Bluetooth integrated circuit chip 523 of the audio circuit board 52 proceed the Bluetooth search matching, the power supply circuit board assembly 21 of the drive power assembly 20 provides the power for the loudspeaker assembly 50, the audio circuit board 52 drives the speaker unit 54 to make the sound so that the light-emitting diode bulb with loudspeaker function 100 plays the music outside, in the process of using the light-emitting diode bulb with loudspeaker function 100 to play the music, it has no need for proceeding the complex connection of the cables. As a result, it is beneficial for a use convenience of the light-emitting diode bulb with loudspeaker function 100.

What is claimed is:

1. A light-emitting diode bulb with loudspeaker function, comprising:

a bulb head;

a drive power assembly assembled to an upper portion of the bulb head, and electrically connected with the bulb head, the drive power assembly including a power supply circuit board assembly, and a wireless module disposed to a top end of the power supply circuit board assembly;

a heat radiator mounted to the upper portion of the bulb head, the drive power assembly being received in the heat radiator;

a light-emitting diode module mounted on the heat radiator, and electrically connected with the power supply circuit board assembly of the drive power assembly;

a loudspeaker assembly mounted on the light-emitting diode module, the heat radiator and the drive power assembly, the loudspeaker assembly including a fastening holder mounted on the light-emitting diode module, the heat radiator and the drive power assembly, an audio circuit board disposed to the fastening holder and electrically connected with the power supply circuit board assembly, a fastening bracket mounted on the audio circuit board, the fastening holder, the light-emitting diode module and the heat radiator, and a speaker unit fastened to the fastening bracket and electrically connected with the audio circuit board which has a main board, a Bluetooth integrated circuit chip disposed on the main board, and a power amplifier chip disposed on the main board; and a cover covered on the heat radiator to locate the light-emitting diode module and the loudspeaker assembly between the cover and the heat radiator, a top of the cover defining a plurality of through-holes.

2. The light-emitting diode bulb with loudspeaker function as claimed in claim 1, wherein the fastening holder has a bottom board, two opposite sides of the bottom board of the fastening holder protrude upward to form two first buckling portions with two top ends thereof showing hook shape, the fastening bracket has a base board, the top end of the first buckling portion hooks a top surface of the base board of the fastening bracket.

3. The light-emitting diode bulb with loudspeaker function as claimed in claim 2, wherein two opposite sides of the main board of the audio circuit board are recessed inward to form two recesses, two opposite sides of a bottom surface of the base board of the fastening bracket protrude downward to form two second buckling portions with two bottom ends thereof showing hook shape, the bottom end of the second buckling portion is buckled in the recess of the audio circuit board and hooks a bottom surface of the main board of the audio circuit board.

4. The light-emitting diode bulb with loudspeaker function as claimed in claim 2, wherein an outer side of the speaker unit defines a basin stand, the basin stand defines a plurality of buckling grooves penetrating therethrough, several portions of a periphery of the top surface of the base board of the fastening bracket protrude upward to form a plurality of third buckling portions with top ends thereof showing hook shape, the top end of the third buckling portion is buckled in the buckling groove and hooks a bottom sidewall of the buckling groove.

5. The light-emitting diode bulb with loudspeaker function as claimed in claim 2, wherein a front and a rear of the main board of the audio circuit board are recessed inward to form two embedding grooves, a front and a rear of a bottom surface of the base board of the fastening bracket protrude downward to form two embedding portions, the embedding portions are embedded in the embedding grooves.

6. The light-emitting diode bulb with loudspeaker function as claimed in claim 2, wherein a middle of the top surface of the base board of the fastening bracket protrudes upward to form a supporting ring, a bottom of the speaker unit is fastened to the supporting ring.

7. The light-emitting diode bulb with loudspeaker function as claimed in claim 2, wherein the heat radiator includes a main body, and a sealing board disposed on a top end of the main body, a top of the sealing board is concaved downward to form a receiving groove, a bottom sidewall of the receiving groove defines a plurality of retaining holes, the light-emitting diode module defines a plurality of fixing holes, a periphery of the bottom board of the fastening holder defines a plurality of first fastening pillars of which middles vertically penetrate therethrough, an outer periphery of the base board of the fastening bracket protrudes outward to form a plurality of fastening boards of which each defines a fastening hole, the loudspeaker assembly further includes a loudspeaker retainer ring and a plurality of fastening elements, the loudspeaker retainer ring is mounted on the fastening bracket and the fastening holder, and surrounds the speaker unit, a periphery of a top end of the loudspeaker retainer ring defines a plurality of second fastening pillars of which middles vertically penetrate therethrough, the light-emitting diode module, the fastening holder, the audio circuit board, the fastening bracket, the speaker unit and the loudspeaker retainer ring are fastened to the heat radiator by virtue of the fastening elements passing through the middles of the second fastening pillars, the fastening holes, the middles of the first fastening pillars, the fixing holes and the retaining holes.

8. The light-emitting diode bulb with loudspeaker function as claimed in claim 7, wherein the loudspeaker assembly further includes a sealing ring, the sealing ring is sleeved around the periphery of the top end of the loudspeaker retainer ring.

9. The light-emitting diode bulb with loudspeaker function as claimed in claim 7, wherein a middle of a bottom surface of the bottom board of the fastening holder protrudes downward to form a propping portion, the propping portion passes through a middle of the light-emitting diode module to resist against the sealing board for forming an interval between the bottom board of the fastening holder and the sealing board, so that the light-emitting diode module is disposed between the bottom board of the fastening holder and the sealing board.

10. The light-emitting diode bulb with loudspeaker function as claimed in claim 7, wherein the drive power assembly includes a shell, the shell surrounds the power supply circuit board assembly, two opposite sides of a top surface of the shell are concaved downward to form two locking fillisters, the bottom sidewall of the receiving groove of the heat radiator defines two locking holes respectively corresponding to the locking fillisters, two opposite sides of a bottom surface of the bottom board of the fastening holder protrude downward to form two locking portions, the two locking portions pass through a middle of the light-emitting diode module and the two locking holes to be locked in the locking fillisters of the shell.

11. The light-emitting diode bulb with loudspeaker function as claimed in claim 10, wherein the drive power assembly includes a first connector mounted to the top end of the power supply circuit board assembly, a second connector docked with the first connector, a middle of a top surface of the shell opens a first opening, a middle of the bottom sidewall of the receiving groove of the heat radiator opens a second opening corresponding to the first opening of the shell, the second connector and a top end of the first connector pass through the first opening to project beyond the top surface of the shell, a top end of the second connector passes through the second opening of the heat radiator to project beyond the bottom sidewall of the receiving groove.

12. The light-emitting diode bulb with loudspeaker function as claimed in claim 11, wherein the light-emitting diode module includes a third connector disposed to a top of the light-emitting diode module, and a fourth connector docked with the third connector, the top end of the second connector of the power supply circuit board assembly passes through the middle of the light-emitting diode module by a first cable to electrically connect with the fourth connector for making the light-emitting diode module electrically connect with the power supply circuit board assembly of the drive power assembly.

13. The light-emitting diode bulb with loudspeaker function as claimed in claim 11, wherein the audio circuit board has two fifth connectors assembled to two opposite sides of a bottom surface of the main board, and two sixth connectors docked with the two fifth connectors, the top end of the second connector of the power supply circuit board assembly passes through the middle of the light-emitting diode module to electrically connect with the sixth connector by a second cable for making the audio circuit board electrically connect with the power supply circuit board assembly, the speaker unit has two connecting pieces of which each defines a connecting hole for connecting with a third cable, the third cable is electrically connected with the sixth connector for making the speaker unit electrically connect with audio circuit board.

* * * * *